United States Patent [19]

Peter, III et al.

[11] Patent Number: 4,474,368

[45] Date of Patent: Oct. 2, 1984

[54] OSCILLATING FINGER SHEET ITEM DETAC APPARATUS

[75] Inventors: Emmett B. Peter, III, Orlando; Wilson P. Rayfield, Longwood, both of Fla.

[73] Assignee: Burroughs Corporation, Detroit, Mich.

[21] Appl. No.: 450,704

[22] Filed: Dec. 17, 1982

[51] Int. Cl.[3] ..... B65H 29/56

[52] U.S. Cl. ..... 271/308; 271/313; 271/DIG. 2

[58] Field of Search ..... 271/306, 307, 308, 312, 271/313, DIG. 2

[56] References Cited

U.S. PATENT DOCUMENTS 3,820,776 6/1974 Fujimoto ..... 271/308

4,119,308 10/1978 Hamaker ..... 271/313

*Primary Examiner*—Richard A. Schacher

*Attorney, Agent, or Firm*—Carl Fissell, Jr.; Edmund M. Chung; Kevin R. Peterson

[57] ABSTRACT

Continuous sheet item delaminating apparatus for electrographic drum printing/copying devices including a relatively flat horizontal coupler member having an upstanding vertical attachment portion and a u-shaped portion normal thereto. A plurality of curved, knife edged item picker fingers are mounted between the parallel legs of the u-shaped portion. The vertical attachment portion is pivotally secured to a rotatable crank rotated by a pulley driven from an associated synchronizer. A rocker-idler arm is fixedly pivoted at one end and is coupled at the opposite end to the coupler member such that rotation of the crank causes the picker fingers to follow a four bar coupler curve toward and away from the sheet item effective to lift the forward edge of the item off the drum and permit the item to fall by gravity onto a safe area for further handling.

10 Claims, 10 Drawing Figures

OSCILLATING FINGER SHEET ITEM DETAC APPARATUS

BACKGROUND OF THE INVENTION

1. Field of the Invention

The invention relates to sheet item delaminating apparatus and more particularly to a four bar linkage for use as an automatic delaminating mechanism for lifting sheet items from an electrostatically energized photo sensitized receptor drum for a copying apparatus.

2. Description of the Prior Art

Most electrographic printing/copying apparatus employs some means for detacking or delaminating the "copy" from the photo-receptor drum to which the sheet item has invariably become electrostatically attracted. Edge aligned item stripper belts moving in the same direction as the item have been employed and are effective to detac the item but obviously limit the edge to edge printing area of the apparatus. Continuously contacting doctor blades have also been used but they tend to score the delicate surface of the photo receptor drum and ultimately destroy copy legibility.

Some copy apparatus have utilized a stripper finger recessed in a circular peripheral groove located in the edge of the photo-receptor drum. This technique also limits the edge to edge printing/copying by the fixed amount of drum space taken up by the groove or grooves therein.

Another technique employs a vacuum method whereby the uppermost sheet item is literally sucked off the photo-receptor drum. Still another mechanism utilizes the Bernoulli effect in which a sudden blast of air causes a low pressure area across the top of the item effective to produce a low pressure area on the order of a vacuum which detacs or delaminates the item off the drum. These latter techniques require relatively expensive and bulky vacuum pumps or blowers. In addition they are fairly noisy.

It is an object therfore of the present invention to provide apparatus which overcomes these and other associated problems in a new, novel and unobvious manner.

SUMMARY OF THE INVENTION

The present invention provides a novel continous motion mechanism for detacking/delaminating sheet items from a photo-receptor drum. Experiment has determined that a stripper finger (or fingers) which made only an instantaneous or momentary contact with the drum, long enough to pick the lead edge of the sheet item up off the drum, would not damage the drum surface but would provide efficient and adequate upward mobility to the sheet to guarantee delamination with minimal scoring of the drum. A refinement of an intermittent motion mechanism utilizing a coupler curve of a four bar linkage (mechanism) whereby the stripper finger (or fingers) follows the coupler curve path and with the motion in the direction of sheet item movement synchronized with the paper movement the stripper finger intercepts the item at the drum surface so as to cause the lead edge of the item to ride up onto the lead edge of the stripper finger. The motion of the stripper finger at this point is slow. However, the speed of the linkage increases immediately thereafter so as to exceed the speed of the paper thus allowing the paper in its forward movement to drop onto an air table (the safe area) wherein the paper is off the drum.

Apparatus embodying the present invention comprises four bar continuous motion linkage wherein a plurality of u-shaped, hook-like item stripper fingers carried by a flexure member are cantilever supported on one end of an irregularly shaped coupler member forming the interconnection in said four bar linkage. The opposite end of the coupler member forming one leg of the linkage is pivotally secured to a crank member rotatably mounted to a fixed support and operably driven from a synchronizer. A rocker member pivoted at one end to the fixed support and pivoted at the opposite end to the coupler member forms the other leg of the four bar linkage.

Means is provided for adjusting the angle between the stripper fingers and the surface of the photo-receptor drum with which the intermittent motion apparatus is employed. A cleaning member or brush is fixedly mounted to the fixed support in the path of movement of said stripper fingers effective to clean the finger ends which latter members are teflon coated to avoid damaging the delicate surface of the drum.

BRIEF DESCRIPTION OF THE PREFERRED EMBODIMENT

The present invention provides a new, novel and heretofore unobvious mechanism for automatically, efficiently, smoothly and rapidly delaminating a sheet item from a photo-receptor drum without damage to the drum surface and without the necessity for adjustment or service over the useful life of the apparatus (hardware). In addition the present construction permits printing/copying from edge to edge of the sheet item without regard to the item borders or edges. Also, should the mechanism ever require replacement or service or repair the assembly is fabricated as a modular, demountable unit, easily inserted into and removed from the base machine with which it is employed.

The present apparatus is adapted to be synchronized with the "Four Bar Interposer Mechanism For Offset Printing" U.S. Ser. No. 342,243 filed Jan. 25, 1982 in the names of Emmett B. Peter III and Wilson P. Rayfield and, like the present invention, assigned to Burroughs Corporation, Detroit, Michigan. Application U.S. Ser. No. 342,243 is a continuation-in-part of original application U.S. Ser. No. 138,704 now abandoned. The "synchronization" aspect of the operation of the device will become clear as the present description proceeds.

Figure 1:
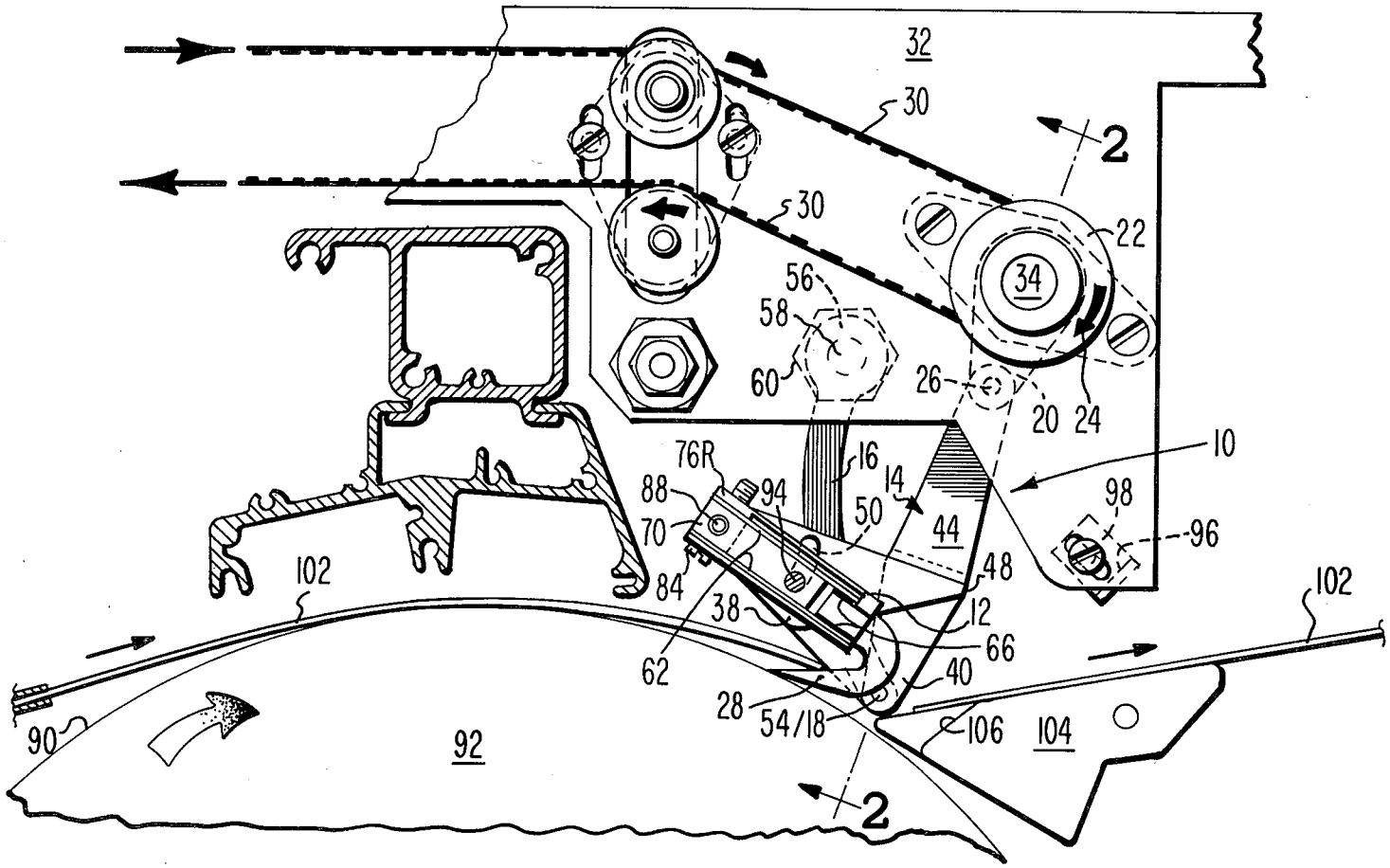
FIG. 1 is a front elevational view of one embodiment of the present invention.

Referring first to FIG. 1 of the drawings, the continuous motion four bar mechanism hereinafter characterized as a delaminating or detacking apparatus, is identified generally at 10. In its broadest aspects the apparatus 10 is seen to comprise a coupler member 12, interconnecting drive link 14 with idler link 16 by means of pin 18. Crank member 20, secured for rotation to drive pulley 22, (the latter being rotatable clockwise in the direction of arrow 24) is pivotally pinned, as at 26, to drive link 14. Coupler member 12 carries a plurality of curved lifter fingers 28 adjustably supported by the coupler member 12 (as will be described in detail subsequently herein).

The delaminating apparatus 10 is synchronized, via a belt 30, with a four bar paper synchronizer apparatus at a preceding stage (not shown). The latter apparatus as earlier noted herein, is illustrated, described and claimed in U.S. Ser. No. 342,243, (continuation-in-part of U.S. Ser. No. 138,704), entitled "Four Bar Interposer Mechanism For Offset Printing", assigned to the same assignee as the present invention.

The complete mechanism embodying the present invention is demountably secured, as a modular, unitary assembly, to a front plate 32 which in turn is mounted to the base machine frame of a photo/copying apparatus (not shown).

Rotation of pulley 22 about mounting shaft 34 by belt 30 rotates crank 20 so as to rockably lift, rotate and lower link 14 repeatedly, causing coupler member 12 carrying lifter fingers 28 to follow the coupler curve 36, shown in dotted outline in FIG. 4, as will be described later on herein.

As seen in more complete detail in FIGS. 2, 3, 4 and 5, member 14 of apparatus 10, comprises an irregularly shaped, rigid casting, such for example, as aluminum, having three integral, separate, spaced, parallel, depending leg portions 38, 40 and 42 respectively. The offset, vertically extending, integral, portion 44 of member 14, provided with a pivot aperture 46 therein for receiving pivot pin 26, is located intermediate legs 38 and 40 adjacent the leading edge 14. The facing or leftward end of member 14 is provided with a arcuate adjustment slot 50, still as will be described later on.

Idler link 16 (FIGS. 2 and 5) is an L-shaped, slightly curved, cast member, the lower end 52 of which is pivotally disposed between legs 40 and 42 by means of cross pin 54. The upper left angled end 56 of link 16 is enlarged to accommodate a mounting pivot shaft 58 (FIG. 5) extending from fixed mounting member 60, the latter being secured to wall plate 32. As illustrated most clearly in FIGS. 9 and 10 the coupler member 12, is seen to comprise a multi-part assembly, as will now be described in detail.

A pair of flat, spring steel members 62—62 are each provided with a plurality of parallel, spaced apart, flexible finger like projections 64, as by die forming or stamping.

An individual, arcuately, curved, item picker finger member 28 is secured (as by gluing) between the confronting parallel ends of each pair of spring flexure members 62—62 to form a unitary assembly. The leftward end of each flexure member 62 is perforated to provide access holes 68, as will become clear shortly. Picker fingers 28 are or maybe Paralene coated thin, (0.004 in.) steel members or each finger member may be fabricated from a material such as "Lexan" as an integral piece. The assembly of the picker fingers 28 and flexures 62—62 is attached to a supporting cross bar member 70 provided with a forwardly projecting adjustment tab or tang 72 so that the leftward ends of the members 62—62 straddle member 70 with holes 68 in alignment with holes 74 in member 70.

Vertical up and down overtravel limit members 76 and 78 respectively (FIG. 10) are provided for the flexure members 62—62. Upper limit member 76 is a substantially flat, plate-like member having opposite parallel depending edge portions 76F and 76R (front and rear respectively). Front member 76F is castellated as 80 with the castellations disposed between fingers 62 and providing a side-to-side gap of 0.010 in. Vertical travel is minimal. Lower member 78 is simply a flat plate covering the complete assembly. Both members 76 and 78 are perforated to accept pan head screws with member 76 having tapped holes 82 for the screws 84.

Figure 10:
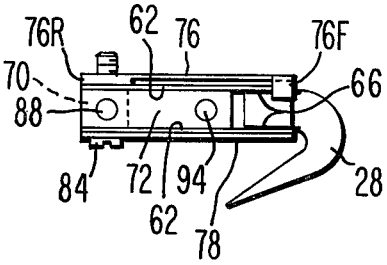
FIG. 10 is a view of the assembled detac lifter finger portion of the present invention.
Figure 5:
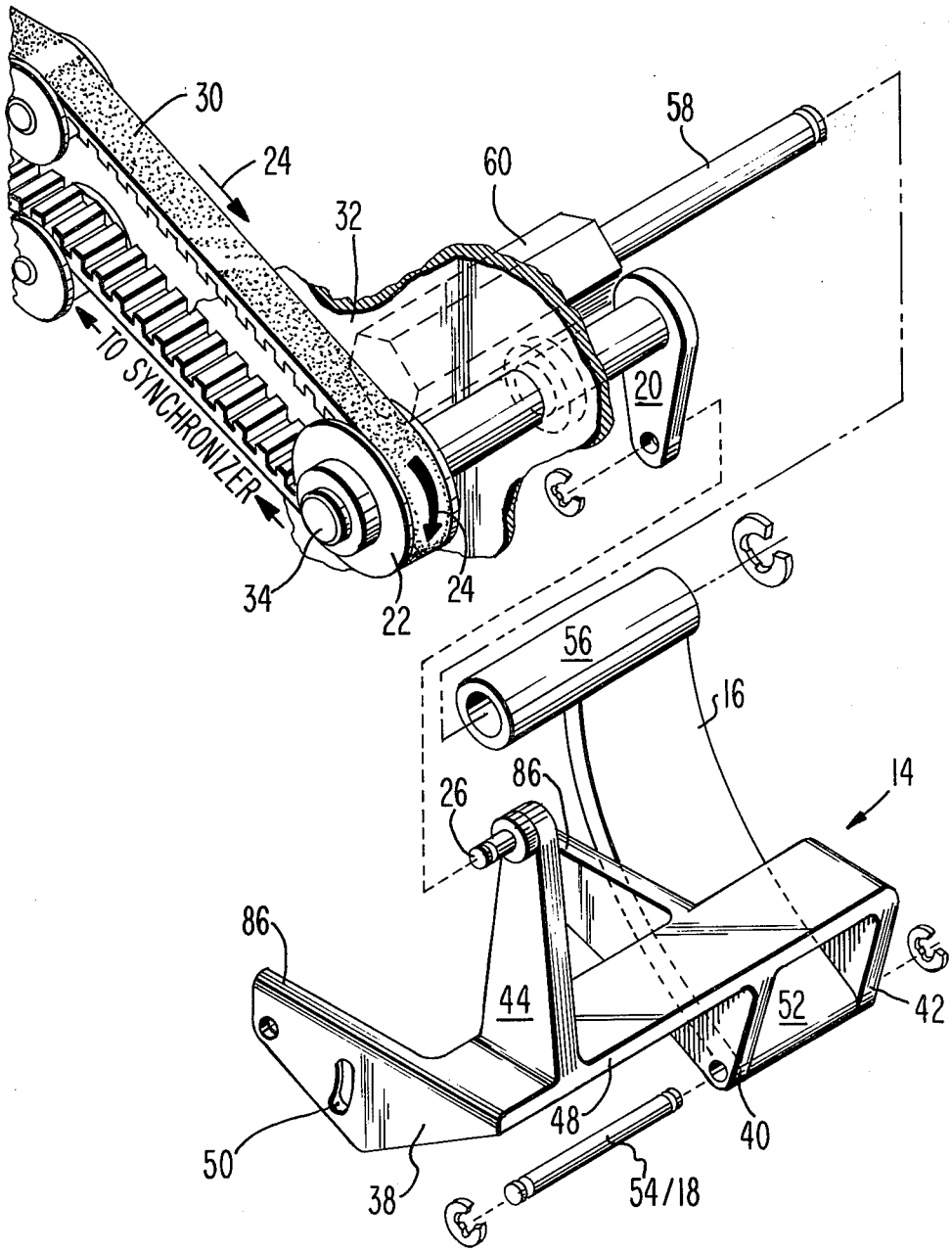
FIG. 5 is an enlarged detail exploded view (not to scale) illustrating the various interacting portions of apparatus embodying the present invention.

This assembly as illustrated in FIG. 10 is next mounted between itengral rearward projecting members 86 (of member 14, FIG. 5) for arcuate movement about pivot pins 88, the latter projecting from opposite ends of cross bar member 70. So that the angle of intercept as well as the distance between fingers 28 and drum surface 90 of drum 92 can be arcuately adjusted. A small bolt 94 projects through tang 72 and into and through the adjustment slot 50 in the left most member 86 (FIG. 5).

The composite flexure assembly provides a relatively light spring force for a relatively large picker finger deflection thereby producing a minimal force of the fingers against the drum. This reduces the problems of drum surface scoring.

Figure 4:
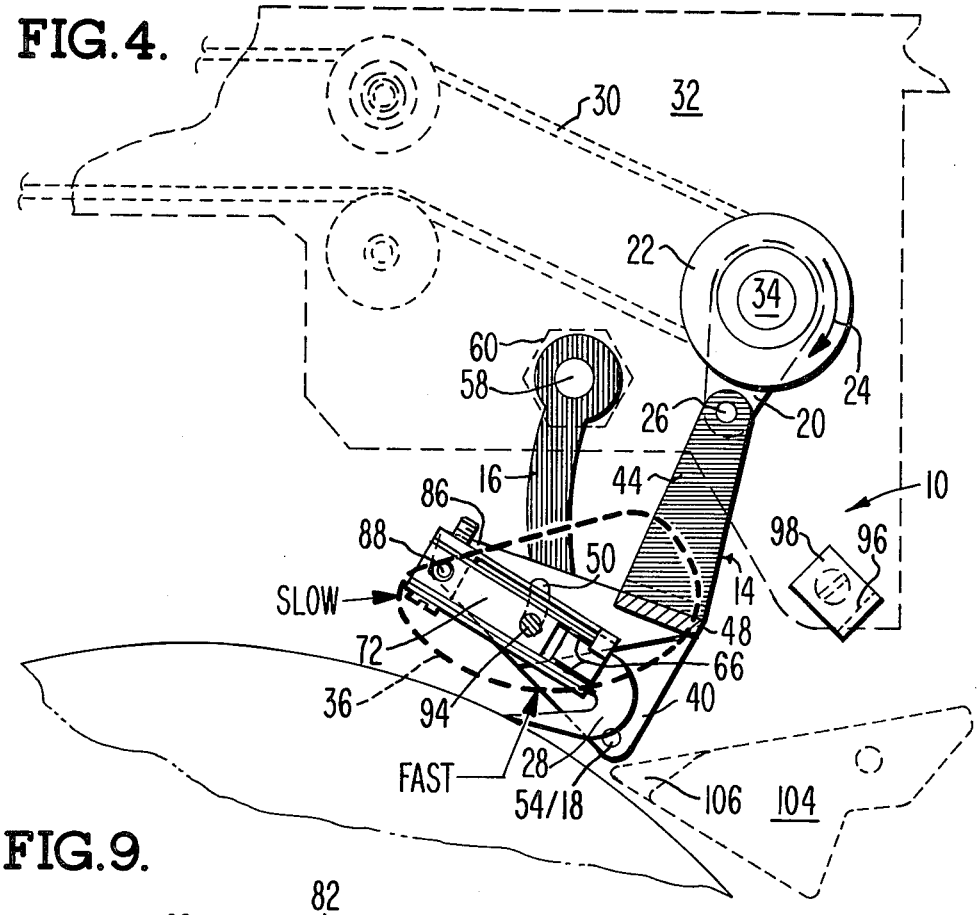
FIG. 4 is a diagrammatic view (not to scale) illustrating the coupler path for the apparatus of FIG. 1.
Figure 8:
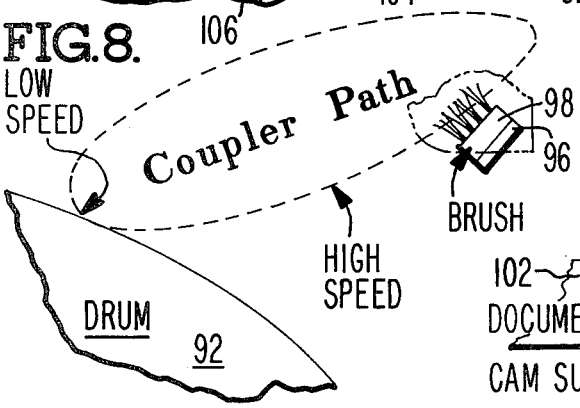
FIG. 8 is a schematic view (not to scale) of the coupler path, cleaning brush and receptor drum relationship.

Adjusting disposed in the path of movement in the mechanism 10 is a small cleaning brush 96, the bristles of which extend outwardly away from the slotted support 98 so as to contact the stripper fingers 28 at the high portion of the coupler curve as shown schematically in FIGS. 4 and 8. The brush effectively removes any residual debris from the finger ends which tend to accumulate thereon during the intermittent contact of the fingers 28 and the drum surface 90. As will be described under the heading "operation" sheet items 102 are effectively lifted from the drum surface 90 and deposited on an air table rapidly, efficiently, automatically by the means thus described.

Operation

As earlier noted herein the present apparatus embodying the subject invention utilizes the coupler curve 36 of a four bar continous motion mechanism 10 wherein a plurality of item stripper fingers 28 are caused to follow the coupler path produced by the mechanism. By providing proper motion and the proper speed of movement of the stripper fingers 28 relative to the paper item 102 movement, the stripper fingers can move down onto the photo-receptor drum 90 fairly slowly so that the paper item 102 is caused to ride up onto the fingers 28. Immediate, automatic, increase in the speed of movement of the stripper fingers 28 to the speed of the item 102 strips the item off the drum. This sudden, abrupt increase in speed is produced by the novel geometry/configuration. Increasing the speed of the stripper mechanism so as to exceed the paper speed thereafter permits the paper to drop onto an associated air table 104 (the safe area) for further handling of the paper item.

Figure 6:
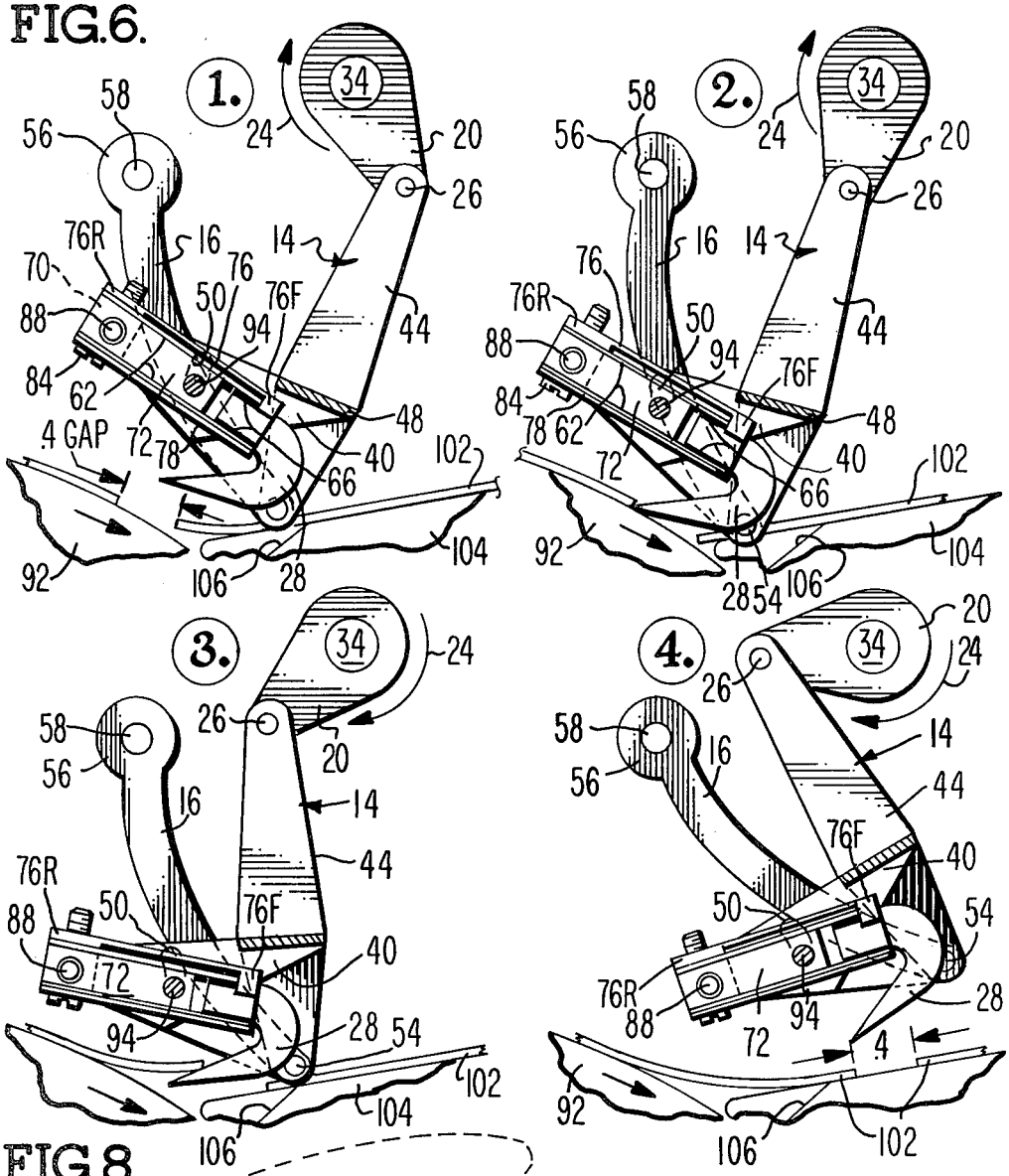
FIG. 6 is a schematic illustration (not to scale) of the operational steps of the detac mechanism during a cycle of operation of the invention.

Referring to FIG. 6 there is illustrated four steps in the continuous motion of the four bar linkage following the coupler path hereinabove described.

In FIG. 6-1 the stripper fingers 28 (the sharp leading ends of which are approximately 0.002 in. thick) are off the drum but approaching the drum with a 0.4 in. gap between leading and trailing paper items. The stripper fingers 28 enter 0.4 in. gap in their movement toward the trailing paper item. At this point the stripper fingers are moving more slowly than the item.

Figure 2:
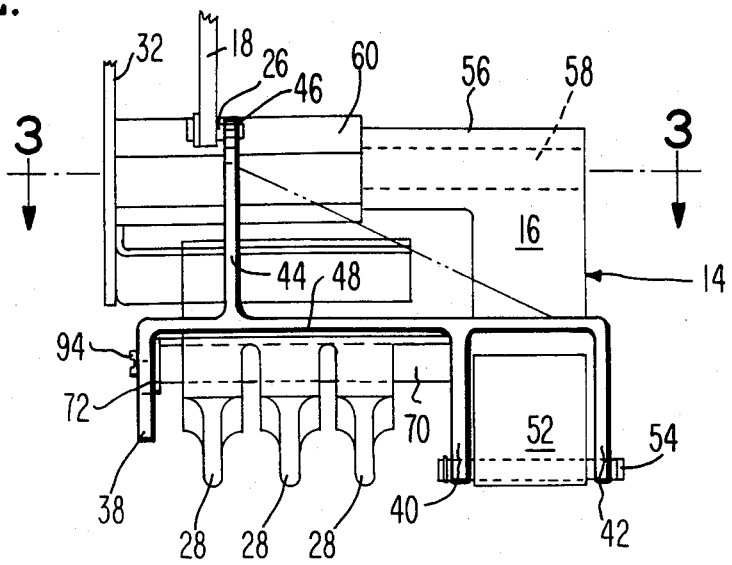
FIG. 2 is a view along the line 2—2 of the apparatus of FIG. 1.

FIG. 6-2 illustrates the stripper fingers entering the 0.4 in. gap still traveling more slowly than the item.

Figure 3:
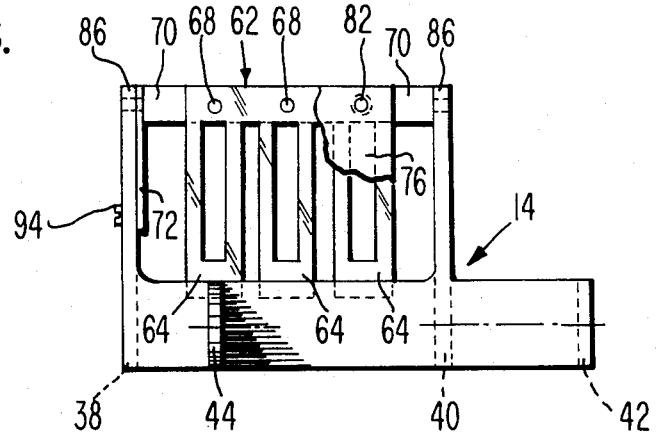
FIG. 3 is top plan view along the line 3—3 of the apparatus of FIG. 2.

In FIG. 6-3, since the speed of the item is greater than that of the stripper fingers the paper item is obliged to and the leading edge does ride up onto the stripper fingers 28.

However, only the leading edge of the paper item contacts the leading edge of the stripper fingers. There is never a surface contact due to the angular relation of the fingers and the drum.

At this point in its operation FIGS. 6-4 as seen also by reference to the coupler curve of FIGS. 4 and 8, the movement of the stripper fingers 28 is abruptly and smoothly speeded up so as to exceed the speed of the item whereupon the fingers 28 move out from under the item which then drops down onto the air table 104 for further handling. Since the drum drive and the picker finger drive are never in perfect or exact synchronism, the finger contact with the drum surface gradually shifts around the surface of the drum. Thus, a spot contact wear or abrasion problem is avoided.

As part of the mechanism, the path of movement of the stripper fingers 28 includes a brush type wiping mechanism. The brush is adjustable and renewable. Thus each complete cycle of operation of the detac apparatus (one cycle per sheet item) the stripper fingers are cleaned of debris so that the fingers in touching the drum surface do not carry abrasive material into contact with the photo-receptor surface of the drum.

It is important to note that by virtue of the angular adjustment feature of the present invention the stripper fingers are permitted no actual surface-to-surface contact with the drum surface.

Figure 7:
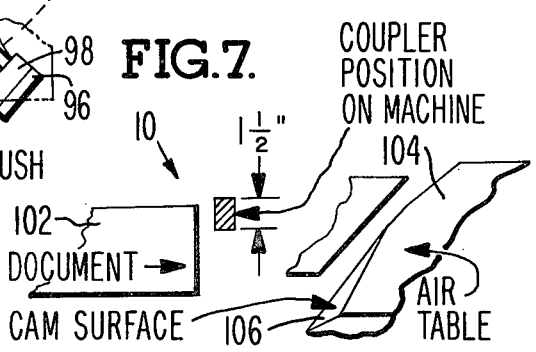
FIG. 7 is a view (not to scale) of the air table relative to the detac coupler.

The detac mechanism, as illustrated schematically in FIG. 7, is positioned at the back of the stripper area i.e. the rear one and one half inch of space. This location provides for operator safety and also provides sufficient room or space for item jam clearance should this become a necessity. The offset nature of the 4-bar coupler results from packaging constraints.

As also illustrated in FIG. 7, the air table 104 is provided with a cam surface 106 along an angled portion of its leading edge relative to the entering paper item 102. The angled cam surface 106 tends to cam the paper item upwardly as it leaves the drum surface so that the paper follows the flat surface of the operably associated air table.

Figure 9:
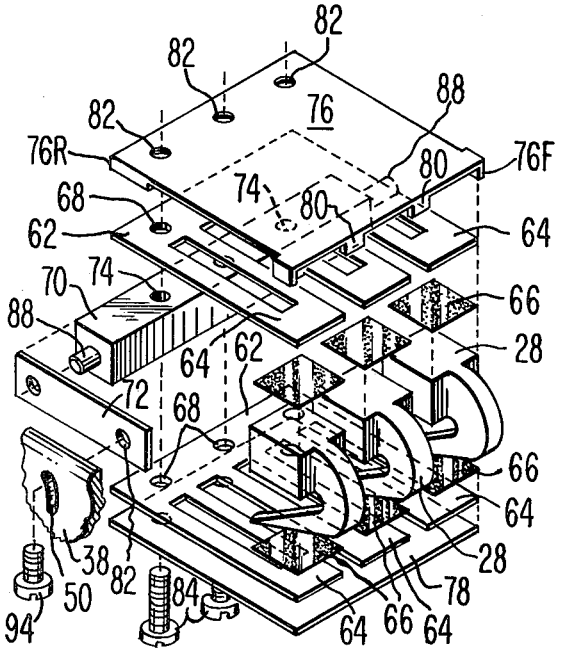
FIG. 9 is a detail view (not to scale) of the detac finger assembly of the present invention.

As has been described hereinbefore the stripper fingers 28 are part of a flexure assembly illustrated in detail in FIGS. 8 and 9. Because a rigid support for the stripper fingers would risk scoring the drum surface upon contact therewith, the flexible members 64—64 are employed and permit vertical travel with the curve finger ends. However, both upper and lower travel limits are imposed upon the fingers by the respective plate limit members 76 and 78 permitting only a limited amount of flexure of members 64—64 while avoiding complete rigidity. Lateral bending or flexure is controlled by the depending castellations 80 of upper limit member 76. In addition, this novel structural arrangement prevents unwanted bending and/or bowing due to paper jams or operator carelessness.

What is claimed is:

1. Oscilating finger, continuous motion detac apparatus for delaminating and lifting a sheet item from a printer/copier drum comprising;

coupler means, a plurality of delaminating picker fingers, carrier means for said picker fingers, said carrier means being operably mounted to said coupler means for conjoint movement therewith, rocker means one end of which is pivoted to a said coupler means, and crank means coupled to synchronizing means and to said coupler means for continuously, cyclically moving said coupler means along a coupler curve for moving said detac fingers into and out of contact with an individual sheet item carried by said drum, effective to lift said item from said drum at the forward speed of said item and thereafter to move completely out of the path of said sheet item at an increased speed so as to permit said item to fall by gravity onto a safe area for further handling.

2. The invention in accordance with claim 1 wherein said coupler means comprises an irregularly shaped rigid member having a u-shaped attachment portion and pivot mounting means for said rocker member.

3. The invention in accordance with claim 2 wherein said coupler means is a rigid casting and further includes an integral upstanding portion orthogonal to said u-shaped portion for pivotal attachment to said crank means.

4. The invention in accordance with claim 1 wherein said picker fingers comprise rigid, substantially u-shaped elements provided with angled knife edge portions extending away from the said carrier means for sliding contact with said items.

5. The invention in accordance with claim 1 wherein said carrier means further includes a rigid horizontal member disposed between the legs of said u-shaped attachment portion and an adjusting tang normal to said rigid member for altering the contact relationship between said picker fingers and said sheet item whereby only the leading edge of said item is contacted by said fingers.

6. The invention in accordance with claim 4 wherein said carrier means further includes oppositely disposed parallel, flat, resilient members, with said u-shaped finger elements disposed between confronting pairs of resilient members and with the opposite ends of said resilient members being rigidly secured between confronting vertical stop members.

7. The invention in accordance with claim 6 wherein said carrier means is pivotally mounted between the parallel leg portions of said u-shaped attachment portion.

8. The invention in accordance with claim 1 wherein said rocker member comprises an arcuately curved rigid member.

9. The invention in accordance with claim 1 further including a pulley member drivingly engaging said crank member and an adjustable cleaning brush disposed in the path of movement of said picker fingers.

10. The invention in accordance with claim 6 wherein the uppermost one of said confronting stop members is castellated effective to prevent sidewise movement of said resilient members.

* * * * *